US006167722B1

(12) United States Patent
Kasezawa et al.

(10) Patent No.: US 6,167,722 B1
(45) Date of Patent: Jan. 2, 2001

(54) REFRIGERATION UNIT

(75) Inventors: Minoru Kasezawa; Jun-ichi Hirohashi, both of Shimizu (JP)

(73) Assignee: Hitachi, Ltd., Tokyo (JP)

( * ) Notice: Under 35 U.S.C. 154(b), the term of this patent shall be extended for 0 days.

(21) Appl. No.: 09/258,301

(22) Filed: Feb. 26, 1999

(30) Foreign Application Priority Data

Mar. 4, 1998 (JP) ..... 10-051762

(51) Int. Cl.[7] ..... F25B 41/00
(52) U.S. Cl. ..... 62/513; 62/505
(58) Field of Search ..... 62/505, 513, 509, 62/199, 200

(56) References Cited

U.S. PATENT DOCUMENTS 4,694,662 * 9/1987 Adams ..... 62/509
4,696,168 * 9/1987 Woods et al. ..... 62/200
5,582,022 * 12/1996 Heinrichs et al. ..... 62/175
6,032,472 * 3/2000 Heinrichs et al. ..... 62/199

FOREIGN PATENT DOCUMENTS

2177786A * 1/1987 (GB) ..... 62/13
52-7407 * 6/1977 (JP) ..... 62/505

* cited by examiner

*Primary Examiner*—William Doerrler
*Assistant Examiner*—Melvin Jones
(74) *Attorney, Agent, or Firm*—Antonelli, Terry, Stout & Kraus, LLP

(57) ABSTRACT

A refrigeration unit using HFC group coolant, having an enhanced cooling capacity so that the performance and the performance coefficient thereof can be enhanced, and the operation thereof can be stably made, the refrigeration unit having a refrigerating cycle in which a compressor 1, a condenser, a expansion valve and an evaporator, the expansion valve are connected in series in the mentioned order, d comprises HFC group coolant, and a subcooler located between the condenser and the evaporator, wherein the HFC group coolant is turned into liquid coolant in the subcooler, and is then branched into a main liquid stream and a substream which super-cools the main liquid stream through a super-cooling expansion valve, and is led into the intermediate stage part of the compressor.

8 Claims, 2 Drawing Sheets

REFRIGERATION UNIT

BACKGROUND OF THE INVENTION

1. Field of the Invention

The present invention relates to a refrigeration unit, and in particular, to the one which does not cause a risk of depletion of the ozone layer, which is suitable for at least recycling thereof, which is preferable in view of stable operation, and which can aim at enhancing the efficiency and the miniaturization thereof.

2. Prior Art of the Invention

Conventionally, there has been known a refrigeration unit, as disclosed in Japanese Laid-Open Patent No. H2-287059, in which coolant is branched on the way from a condenser to an evaporator into a main liquid stream and a substream for super-cooling the main stream liquid through the intermediary of a super-cooing expansion valve so as to enhance the energy saving and the fron gas saving.

In the above-mentioned technology, coolant R22 which has been used in conventional refrigerating units is not preferable in view the prevention of global warming and deletion of the ozone layer or recycling thereof. Thus, it has been desirable to use coolant in which no chlorine components are contained by a small quantity in order to cope with the above-mentioned problems, and further, the efficiency thereof has to be enhanced for the purpose of energy saving.

In particular, a refrigerating unit using the above-mentioned coolant with no chlorine components offers problems, that is, an air-cooled condenser unit installed outdoors has to be incorporated therein with a receiver so as to have a large-size in comparison with conventional refrigeration units using coolant R22, and is disadvantageous in view of the installation space and recycling thereof and the like.

Further, it is difficult to super-cool condensed liquid of HFC group triple-mixed coolant (HFC125 having a composition ratio of 40 to 48%, HFC143 having a composition ratio of 47 to 57% or HFC134*a* having a composition ratio of 2 to 8%) which is nonchlorine group coolant, that is, the heat-exchange volume thereof required for obtaining the same degree of super-cooling as that of coolant R22 becomes twice as large as that of the latter in view of the physical properties thereof. Further, the air-cooled condenser unit has a low degree of heat-exchanging efficiency, and accordingly, in order to obtain a high degree of super-cooling, the unit has to have a large-size.

SUMMARY OF THE INVENTION

The present invention is devised in order to solve the above-mentioned problems inherent to the above-mentioned conventional technology, and accordingly, an object of the present invention is to provide a refrigerating unit which does never cause deletion of the ozone layer so as to be suitably recycled for environmental response, which can enhance the efficiency and which is small-sized., To the end, according to a fist aspect of the present invention, there is provided a refrigeration unit having a refrigerating cycle in which a compressor, a condenser, an expansion valve and an evaporator are connected in series in the mentioned order, comprising HFC group coolant circulating the refrigerating cycle and a subcooler located between the condenser and the evaporator, wherein the HFC group coolant which is turned into a liquid form, is branched into a main liquid stream and a substream for super-cooling the main liquid stream through the super-cooling expansion valve before it is led into an intermediate pressure part of the compressor.

With this arrangement in which the HFC group coolant is used, it is possible to prevent the global warming and the deletion of the ozone layer, and as well to adapt to the recycling. Moreover, the HFC group coolant is turned from a liquid phase into a wet gas phase by the super-cooling expansion valve so as to super-cool the main liquid stream in the subcooler while the thus evaporated HFC group coolant is led into the intermediate pressure part of the compressor, and accordingly, stable liquid coolant can be obtained so as to obtain a high degree of super-cooling for the main liquid stream, thereby it is possible to enhance the refrigerating capacity.

Further, in a specific form of the above-mentioned arrangement, according to the present invention, the branching on the way from the condenser to the evaporator is made on the outlet side of the subcooler.

Further, the coolant which has branched for super-cooling is sufficiently super-cooled, and accordingly, the super-cooling of the liquid coolant becomes stable.

Further, according to a second aspect of the present invention, there is provided a refrigeration unit having a refrigerating cycle in which a compressor, a condenser, an expansion valve and an evaporator are connected in series in the mentioned order, comprising HFC group coolant circulating through the refrigerating cycle, a subcooler located between the condenser and the evaporator, and a receiver located between the subcooler and the evaporator, wherein the HFC group coolant from the condenser, which has been turned into a liquid phase is branched into a main liquid stream and a substream at the receiver, and the substream super-cools the main liquid stream through the super-cooling expansion valve, and is thereafter led into an intermediate pressure part of a compressor.

With this arrangement, the coolant in the substream for super-cooling, which has been evaporated in the subcooler can be taken out through the receiver, and accordingly, the super-cooling coolant does not contain flash gas so as to obtain highly stable super-cooling for the liquid coolant, thereby it is possible to enhance the degree of super-cooling through the latent heat of vaporization. Accordingly, even with such an arrangement that an air-cooled condenser is used as the condenser, and the receiver is added, the condenser unit as a whole can become compact while no risk of deletion of the ozone layer occurs, thereby it is possible to adapt to the recycling.

Further, according to a third aspect of the present invention, there is provided a refrigeration unit having a refrigerating cycle in which a compressor, a water-cooled condenser, an expansion valve and an evaporator are connected in series in the mentioned order, comprising HFC group coolant circulating through the refrigerating cycle, and a subcooler located between the condenser and the evaporator, wherein the HFC group coolant in a main liquid stream led from the condenser into the evaporator is branched off by a part as a substream from the lower part of the condenser in order to cool the main liquid stream through the super-cooling expansion valve, and the substream is then led into an intermediate pressure part of a compressor.

With this arrangement, the branched substream for super-cooling is taken out from the lower part of the condenser, and accordingly, the HFC group coolant does not contain flash gas, thereby it is possible to achieve stable super-cooling of the coolant. Thus, even though a water-cooled condenser is used, the refrigeration unit can become compact, and since no risk of deletion of the ozone layer occurs, the refrigeration unit can be adapted for the recycling.

Further, according to a fourth aspect of the present invention, there is provided a refrigeration unit composed of a refrigerating cycle in which a compressor, a condenser, an expansion valve and an evaporator are connected in series in the mentioned order, comprising HFC group coolant circulating through the refrigerating cycle, a subcooler located between the condenser and the evaporator, a super-cooling pipe line for branching the HFC group coolant from the condenser, a super-cooling expansion valve provided in the super-cooling pipe line, and a screw compressor having an economizer port connected thereto with the super-cooling pipe line and used as the compressor mentioned above. Further, according to a fifth aspect of the present invention, there is provided a refrigeration unit composed of a refrigerating cycle in which a compressor, a condenser, an expansion valve and an evaporator are connected in series in the mentioned order, comprising HFC coolant circulating through the refrigerating cycle, a subcooler located between the condenser and the evaporator, a receiver located between the subcooler and the condenser, a super-cooling pipe line for branching the HFC group coolant from the receiver, a super-cooling expansion valve provided in the super-cooling pipe line, and a screw compressor having an economizer port connected thereto with the super-cooling pipe line, and used as the compressor mentioned above.

Further, according to a sixth aspect of the present invention, there is provided a refrigeration unit composed of a refrigerating cycle in which a compressor, a water-cooled condenser, an expansion valve and an evaporator are connected in series in the mentioned order, comprising HFC coolant circulating through the refrigerating cycle, a subcooler located between the condenser and the evaporator, a super-cooling pipe line for branching the HFC group coolant from the lower part of the condenser, a super-cooling expansion valve provided in the super-cooling pipe line, and a screw compressor having an economizer port connected thereto with the super-cooling pipe line, and used as the compressor mentioned above.

Further, according to a seventh aspect of the present invention, there is provided a refrigeration unit composed of a refrigerating cycle in which a screw compressor having an economizer port, a condenser, an expansion valve and an evaporator are connected in series in the mentioned order, comprising HFC group coolant circulating the refrigerating cycle, a subcooler located between the condenser and the evaporator, a receiver located between the subcooler and the condenser, a means for branching the HFC group coolant at the receiver, and leading the same into the economizer port of the screw compressor, and an air-cooled condenser unit having a width of 3,000 mm, a depth of 800 mm and a height of 1,200 mm and having a rated output power of 30 kW.

With this arrangement in which the coolant to be super-cooled, is taken out from the receiver, it can easily have a dryness of 0 even though it is of the HFC group, and accordingly, the HFC group coolant can be stably and sufficiently super-cooled even though it is likely to change its phase or to become a two-phase condition. Further, since the receiver is not provided in the condenser unit, the condenser unit can become compact. In particular, it has a width of 3,000 mm, a depth of 800 mm a height of 1,200 mm, and accordingly, it is adaptable for recycling.

Detailed explanation will be hereinbelow made of a preferred embodiments of the present invention with reference to the accompanying drawings in which:

DETAILED DESCRIPTION OF THE INVENTION

Figure 1:
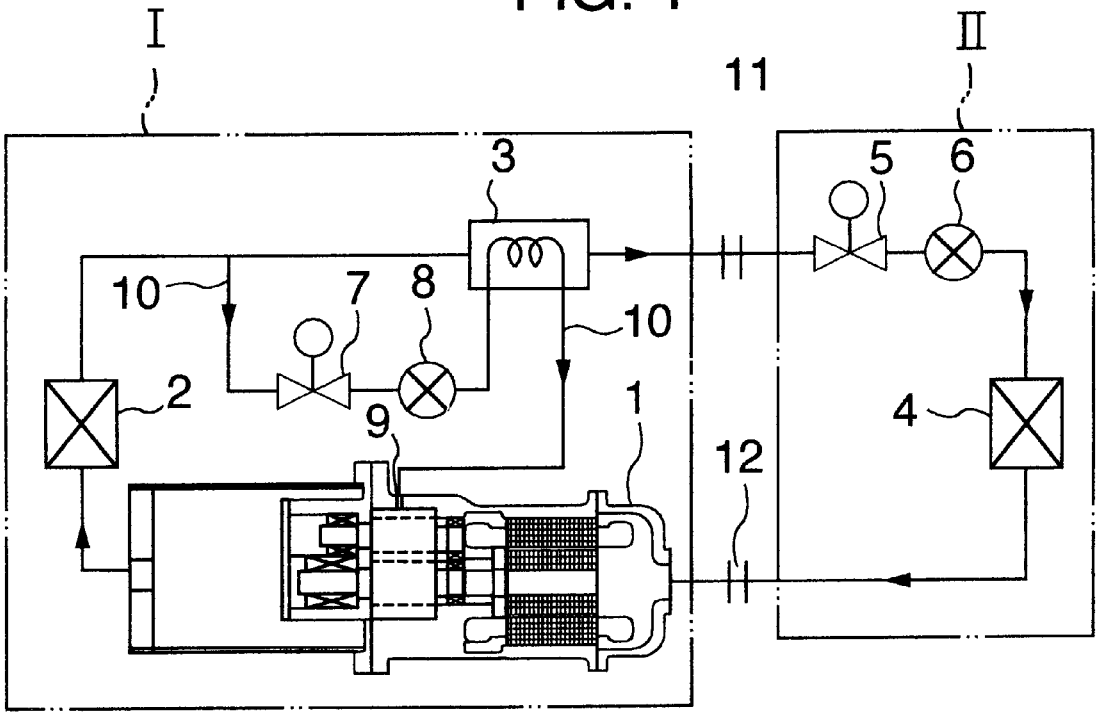
FIG. 1 is a systematic view illustrating a refrigerating cycle in a refrigeration unit in an embodiment of the present invention.

It is noted that the arrows shown in the drawings indicate the flowing direction of coolant.

Referring to FIG. 1, there are shown a refrigeration unit I, and low pressure side equipment, which are connected together through pipe line connection parts 11 and 12 so as to constitute a refrigerating cycle.

In the case of using an HFC group coolant such as a triple mixed coolant composed of HFC125 (having a composition ratio of 40 to 48%), HFC143*a* (having a composition ratio of 47 to 57%) and HFC134*a* (having a composition ratio of 2 to 8%) in an air-cooled refrigerating unit, insufficient super-cooling of liquid coolant occurs in a condenser, resulting in occurrence of problems such as insufficient cooling capacity of the refrigeration unit and overheating of a compressor, being caused by flash gas. Further, the HFC group coolant has a low latent heat which is 70% of that of a coolant R22 on the evaporator side, the higher the degree of super-cooling, the higher the cooling capacity. Thus, in the case of using the HFC coolant, it is important to sufficiently super-cool the condensing liquid in order to enhance the cooling capacity and the reliability.

Referring to FIG. 1, there shown a screw compressor 1 having an economizer port 9, a condenser 2 provided downstream of the compressor 1, and a subcooler 3 provided downstream of the condenser 2. Gas coolant discharged from the screw compressor 1 is cooled and condensed by the condenser 2 so as to be turned into liquid coolant. On the way of the condenser 2 to the lower pressure side equipment II, the coolant is super-cooled in the subcooler 3 so as to be turned into liquid coolant having a sufficiently high degree of super-cooling. The liquid coolant is then changed into a low pressure wet gas condition in the low pressure side equipment II composed of a solenoid valve 5, an expansion valve 6 and an evaporator 4, by means of the expansion valve 6, and is then evaporated in the evaporator 4. Finally, it is sucked into the screw compressor 1.

A pipe line from the condenser 2 to the subcooler 3 is connected, intermediary thereof, to the economizer port 9 of the compressor 1, through a super-cooling pipe line 10 which is incorporated therein with a super-cooling expansion valve 8. The coolant flowing from the condenser 2 to the subcooler 3 is taken out by a part into the super-cooling pipe line 10, and is turned into a wet gas condition in the super-cooling expansion valve 8. Then, it is evaporated in the subcooler 3 so as to super-cool the coolant flowing into the low pressure side equipment II, and thereafter, it is sucked into the economizer port 9 of the screw compressor 9.

With this arrangement, since the generation of flash gas can be restrained when it is led into the low pressure side equipment even though the HFC group coolant which is difficult to be super-cooled, is used, thereby it is possible to stably operate the refrigeration unit.

Further, since the liquid coolant can be super-cooled by a large degree, the cooling capacity can be enhanced so as to increase the performance coefficient of the refrigeration unit, thereby it is possible to reduce the power consumption. Specifically, in the refrigeration unit having a rated output power of 30 kW, the cooling capacity can be enhanced from 5,400 kcal/h to 62,000 kcal/h, that is, the performance coefficient is increased from 2.2 to 2.4.

Further, since a positive displacement compressor such as the screw compressor 1, can be incorporated in its intermediate compression stage with a coolant suction port such as the economizer port 9, in comparison with a reciprocating type compressor, the inherent suction volume from the low pressure side equipment II is invariable even though the coolant is injected into the economizer port 9, thereby it is possible to prevent the cooling capacity from lowering.

Figure 2:
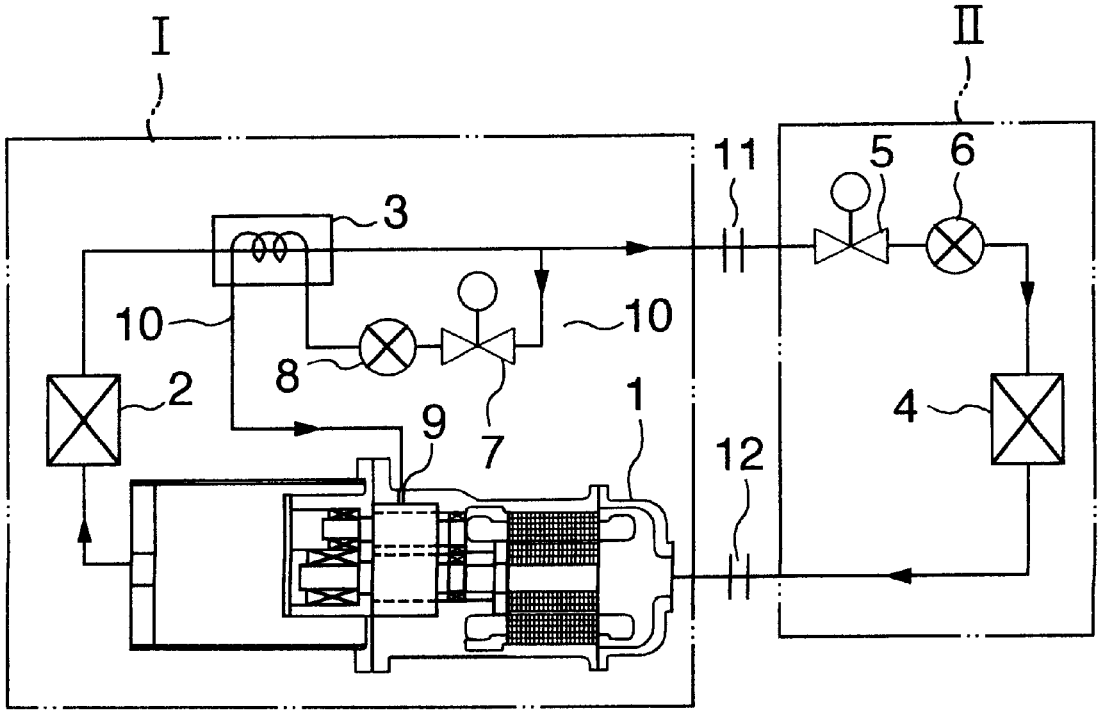
FIG. 2 is a systematic view illustrating a refrigerating cycle in a refrigeration unit in another embodiment of the present invention.

Referring to FIG. 2 which shows a second embodiment of the present invention, this arrangement is similar to that shown in FIG. 1, except that the super-cooling pipe line 10 branches off from the coolant pipe line extending from the subcooler 3 to the pipe line connection part 11, and is then connected to the economizer port 9 of the screw compressor 1. That is, the coolant for super-cooling the coolant which has been evaporated in the subcooler 3 and which flows into the low pressure side equipment II is taken out from the super-cooled liquid coolant outlet side of the subcooler 3.

It is noted that noncondensed gas can be prevented from being mixed into the super-cooling liquid coolant even though HFC group coolant is used since a part of the liquid coolant which has been super-cooled so as to have a sufficiently high degree of super-cooling, is used as the super-cooling coolant, and as a result, the refrigeration unit can be stably operated although the HFC group coolant is used therein, thereby it is possible to enhance the refrigerating capacity.

Figure 3:
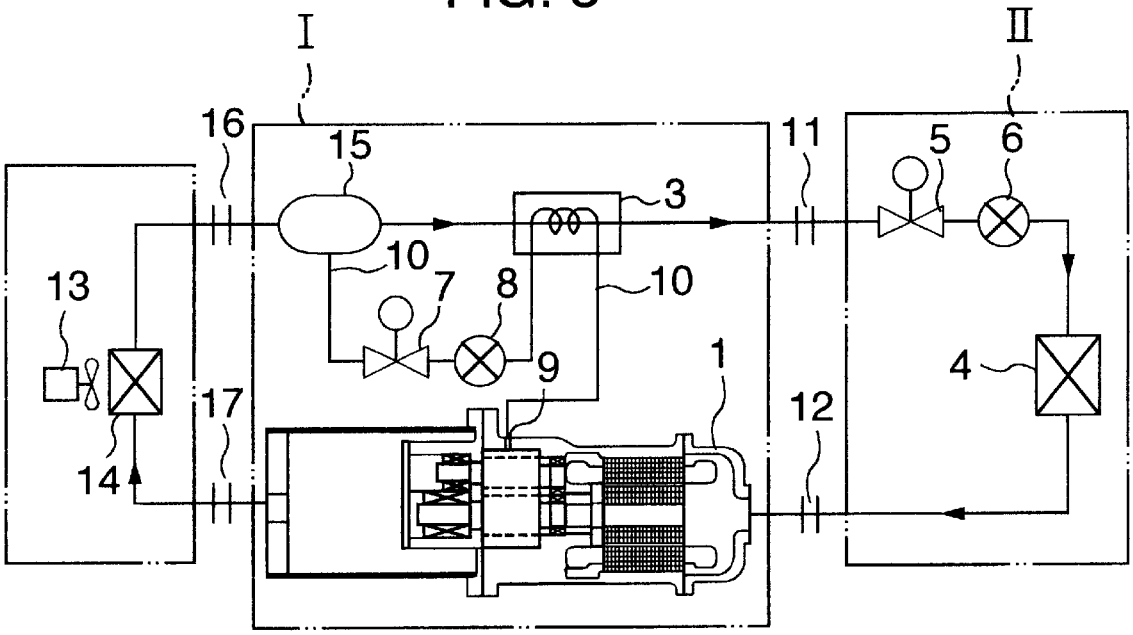
FIG. 3 is a systematic view illustrating a refrigerating cycle in an air-cooled refrigeration unit in further another embodiment of the present invention.

Referring to FIG. 3 which shows a third embodiment of the present invention, this arrangement is similar to that shown in FIG. 2, except that an air-cooled separate type refrigeration unit is used, and is composed of a compressor unit Ia and an air-cooled condenser unit Ib which are connected with the low pressure side equipment through the pipe line connection parts 11, 12, similar to that shown in FIG. 1, and further which are connected together through pipe line connection parts 16, 17, so as to constitute a refrigerating cycle.

The HFC group coolant in the form of gas discharged from the screw compressor 1 is cooled in an air-cooled condenser 14 by heat-exchanging air generated by a cooling fan 13 so as to be condensed into liquid coolant which is then accumulated in the receiver 15, and is super-cooled in the subcooler 3. The super-cooling pipe line 10 is connected between the receiver 15 and the economizer port 9 of the screw compressor 1. That is, the coolant flowing into the low pressure side equipment II is super-cooled by the coolant which is taken from the receiver 15.

Since the coolant for super-cooling is taken out from the receiver 15, the super-cooling coolant has a zero degree of dryness even though it is HFC group coolant, and accordingly, it is possible to prevent the super-cooling expansion valve 8 from lowering its capability being caused by mixing of noncondensed gas. Accordingly, even though HFC group coolant which is like to be turned into a two-phase condition, is used, the super-cooling can be stably carried out. Further, since it is not necessary to provide the receiver 15 within the air-cooled condenser unit Ib, the air-cooled condenser unit can be made to be small-sized and compact. Specifically, an air-cooled condenser unit having a rated output power of 30 kw, may have such dimensions that its width is 3,000 mm, a depth 800 mm, and the height 1,200 mm, in comparison with an air-cooled condenser unit having a width of 3,000 mm, a depth of 1,100 mm and a height of 1,200 mm, which has been used in a conventional refrigeration unit.

Figure 4:
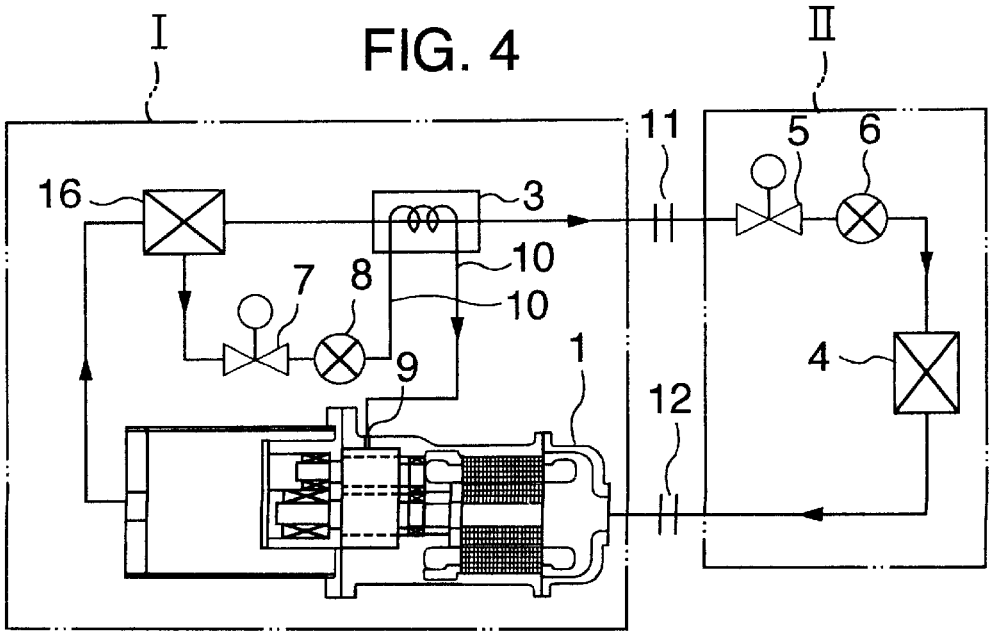
FIG. 4 is a systematic view illustrating a refrigerating cycle in a water-cooled refrigeration unit in further another embodiment of the present invention.

Referring to FIG. 4 which shows a water-cooled refrigeration unit in a fourth embodiment, HFC group gas coolant discharged from the screw compressor 1 is cooled in a water-cooled condenser 18 so as to be turned into a are quid coolant which is once accumulated in the lower pare of the water-cooled condenser 18, and is then super-cooled by the subcooler 3. The super-cooling pipe line 10 is connected between the lower part of the water-cooled condenser 18 and the economizer port 9 of the screw compressor. That is, the coolant for super-cooling the coolant flowing into the low pressure side equipment II, is taken out from the lower part of the water-cooled condenser 18.

The HFC group coolant accumulated in the lower part of the water-cooled condenser 18 is used as the super-cooling coolant, it has a zero degree of dryness even though it is likely to be turned into a two-phase condition, and accordingly, no uncondensed gas is mixed thereinto, thereby it is possible to stably and sufficiently super-cool the liquid coolant even though the HFC group coolant is used.

In the case of a refrigeration unit in which a reciprocating type compressor is installed, it cannot be formed in its intermediate compression stage part with a coolant suction port such an economizer port as is incorporated in the screw compressor, in view of its structure, and accordingly, the coolant which has been evaporated in the subcooler has to be returned into the suction port of the compressor. Thus, the suction volume from the condenser is decreased, resulting in lowering of the refrigerating capacity. However, in such a case that a positive displacement type compressor, that is, a screw or scroll type compressor is used, even though the coolant is injected during compression stage, the inherent suction volume of the compressor on the suction side is invariable, and accordingly, it is possible to prevent lowering of the refrigerating capacity.

As mentioned above, in a refrigeration unit there are incorporated a screw compressor having an economizer port, a pressure reducing mechanism by which liquid coolant is turned into a wet gas condition, a subcooler in which the coolant is super-cooled while coolant evaporated therein is returned through the economizer port, wherein even with the use of HFC group coolant which is difficult to be super-cooled, the liquid coolant to be led into the low pressure side equipment, is restrained from being mixed with flash gas, thereby it is possible to stably operate the refrigeration unit.

Further, even with the use of the HFC group coolant, the liquid coolant to be led into the low pressure side equipment can be highly super-cooled, thereby it is possible to increase the cooling capacity so as to enhance the performance of the refrigeration unit, and to enhance the performance coefficient of the refrigeration unit so as to reduce the power consumption.

Further, coolant which is to be evaporated in the subcooler, for super-cooling, is taken out from the outlet side of the subcooler so as to prevent uncondensed gas from being mixed into the super-cooling coolant, thereby it is possible to stably operate the refrigeration unit with an increased refrigerating capacity.

Further, in an air-cooled refrigeration unit, coolant for super-cooling coolant which has been evaporated in the subcooler and which is to flow into the low pressure side equipment, is taken out from the receiver, and accordingly, the coolant having zero degree of dryness can be used as the coolant for super-cooling, thereby it is possible to stably operate the refrigeration unit with an enhanced cooling capacity.

Further, in the air-cooled separate type refrigeration unit, it is not required to provide the receiver in the air-cooled condenser unit, and accordingly, the air-cooled condenser unit can become more compact. As result, the installation space therefor can be greatly reduced, and the strength of a building installed on its roof with the air-cooled condenser, can become lower, thereby it is possible to reduce the cost of the construction of the building.

According to the present invention, HFC group coolant used as coolant circulating through a refrigerating cycle, and having been turned into liquid coolant through the condenser, is branched into the main stream and the substream which is led through the super-cooling expansion valve, for super-cooling the main stream, and which is then led into the intermediate stage part of the compressor, and accordingly, no flash gas is mixed into the super-cooling coolant in the substream, thereby it is possible to prevent the global warming and deletion of the ozone layer, and further to be adaptable for recycling. Further, since the main stream is super-cooled, it is possible to enhance the refrigerating cycle.

Further, according to the present invention, HFC group coolant used as coolant circulating through a refrigerating cycle, and having been turned into liquid coolant through the condenser, is branched into the main stream and the substream which is led through the super-cooling expansion valve, for super-cooling the main stream, and which is then led into the intermediate stage part of the compressor, and accordingly, no flash gas is mixed into the super-cooling coolant in the substream, thereby it is possible to stably super-cool the liquid coolant. Thus, the refrigeration unit can become compact and can be adapted for recycling.

Further, according to the present invention, HFC group coolant used as a coolant circulating through a refrigerating cycle using a water-cooled condenser, and is then branched into a main stream and a substream in the lower part of the evaporator, which is led into the intermediate pressure stage of the compressor after it super-cools the main liquid stream. Accordingly, no flash gas is contained in the HFC group coolant for super-cooling, and therefore, super-cooling by stable liquid coolant can be obtained. Thus, the refrigeration unit can become compact even though the water-cooled condenser is used.

With this arrangement, there is no risk of deletion of the ozone layer so as to enhance the environmental response, that is, the adaptation for recycling is suitable, and further, it is possible to provide a small-sized refrigeration with enhanced efficiency.

What is claimed is:

1. A refrigeration unit having a refrigerating cycle in which a compressor, a condenser, an expansion valve and an evaporator are connected in series, in the mentioned order, comprising:

HFC group coolant circulating through said refrigerating cycle; and a subcooler having an inlet side and an outlet side, said subcooler being connected between said condenser and said evaporator;

wherein said HFC group coolant is turned into a liquid coolant in said condenser, and is then branched on the outlet side of said subcooler into a main stream and a substream for super-cooling the main stream by way of a super-cooling expansion valve, which is led into an intermediate stage part of said compressor.

2. A refrigeration unit having a refrigerating cycle in which a screw or scroll compressor, a condenser, an expansion valve and an evaporator are connected in series, in the mentioned order, comprising:

HFC group coolant circulating through said refrigerating cycle; and a subcooler located between said condenser and said evaporator;

a receiver located between said subcooler and said condenser;

wherein said HFC group coolant is turned into a liquid coolant in said condenser, and is then branched at said receiver into a main stream and a substream for super-cooling the main stream by way of a super-cooling expansion valve, which is led into an intermediate stage part of said screw or scroll compressor.

3. A refrigeration unit having a refrigerating cycle in which a screw or scroll compressor, a water-cooled condenser, an expansion valve and an evaporator are connected in series in the mentioned order, comprising;

HFC group coolant circulating through said refrigerating cycle; and a subcooler located between said condenser and said evaporator;

wherein a part of said BFC group coolant which has been turned into a liquid coolant in said condenser is taken out from a main liquid stream of said HFC group coolant led from said condenser to said evaporator in the lower part of said condenser, for super-cooling the main stream, and is led into an intermediate stage part of said screw or scroll compressor.

4. A refrigeration unit having a refrigerating cycle in which a screw compressor having an economizer port, a condenser, an expansion valve and an evaporator are connected in series in the mentioned order;

HFC coolant circulating through said refrigerating cycle;

a subcooler located between said condenser and said evaporator;

a super-cooling pipe line for branching said HFC group coolant from said condenser;

a super-cooling expansion valve provided in said super-cooling pipe line;

wherein said super-cooling pipe line is connected to said economizer port of said compressor.

5. A refrigeration unit having a refrigerating cycle in which a screw compressor having an economizer port, a condenser, an expansion valve and an evaporator are connected in series in the mentioned order;

HFC coolant circulating through said refrigerating cycle;

a subcooler located between said condenser and said evaporator;

a receiver located between said subcooler and said condenser;

a super-cooling pipe line for branching said HFC group coolant from said receiver; and a super-cooling expansion valve provided in said super-cooling pipe line;

wherein said super-cooling pipe line is connected to said economizer port of said compressor.

6. A refrigeration unit having a refrigerating cycle in which a screw compressor having an economizer port, a water-cooled condenser, an expansion valve and an evaporator are connected in series in the mentioned order;

HFC coolant circulating through said refrigerating cycle;

a subcooler located between said condenser and said evaporator;

a receiver located between said subcooler and said condenser;

a super-cooling pipe line for branching said HFC group coolant from the lower part of said condenser;

a super-cooling expansion valve provided in said super-cooling pipe line; and wherein said super-cooling pipe is connected to said economizer port of said screw compressor.

7. A refrigeration unit having a refrigerating cycle in which a screw compressor having an economizer port, an air-cooled condenser unit, an expansion valve and an evaporator are connected in series in the mentioned order;

HFC coolant circulating through said refrigerating cycle;

a subcooler located between said condenser unit and said evaporator;

a receiver located between said subcooler and said condenser;

a means for branching said HFC group coolant from the lower part of said condenser unit, and for leading the same to said economizer port of said screw compressor; and wherein said air-cooled condenser unit has a width of 3,000 mm, a depth of 800 mm and a height of 1,200 mm and a rated power of 30 kW.

8. A refrigeration unit having a refrigerating cycle in which a screw or scroll compressor, a condenser, an expansion valve and an evaporator are connected in series, in the mentioned order, comprising:

HFC group coolant circulating through said refrigerating cycle; and a subcooler located between said condenser and said evaporator;

wherein said HFC group coolant is turned into a liquid coolant in said condenser, and is then branched into a main stream and a substream for super-cooling the main stream by way of a super-cooling expansion valve, which is led into an intermediate stage part of said screw or scroll compressor.

* * * * *